United States Patent [19]

Ovitz, III

[11] 4,324,379

[45] Apr. 13, 1982

[54] DISPLAY SHELF LOCK

[75] Inventor: Ernest Ovitz, III, Galva, Ill.

[73] Assignee: John H. Best & Sons, Inc., Galva, Ill.

[21] Appl. No.: 111,117

[22] Filed: Jan. 10, 1980

[51] Int. Cl.[3] ..... E04G 5/06; F16L 3/06; F21L 15/08

[52] U.S. Cl. ..... 248/222.1; 248/243

[58] Field of Search ..... 248/222.1, 243, 73; 211/192

[56] References Cited

U.S. PATENT DOCUMENTS

| | | | |
|---|---|---|---|
| 3,601,432 | 8/1971 | Fenwick | 211/192 X |
| 3,680,711 | 8/1972 | Brucker | 211/192 |
| 3,697,034 | 10/1972 | Shell | 248/243 |
| 3,888,440 | 6/1975 | Rebentisch | 248/73 |
| 4,048,768 | 9/1977 | Good | 248/222.1 X |
| 4,133,433 | 1/1979 | Wolf | 211/192 |
| 4,154,419 | 5/1979 | Breidenbach | 211/192 X |
| 4,198,913 | 4/1980 | Haworth | 248/243 |

*Primary Examiner*—Ronald Feldbaum

*Attorney, Agent, or Firm*—Kinzer, Plyer, Dorn & McEachran

[57] ABSTRACT

A lock for a shaft bracket of the type having hooks which engage slots in an upright support member. The lock prevents inadvertent raising of the shelf support bracket hooks which could cause the hooks to fall out of the slots. The lock is of one-piece construction having clips which slidably engage the shelf support bracket. An ear on the lock projects into a slot of the upright support member, adjacent the top edge of the slot. The ear prevents vertical movement which could release the hook from the slot.

7 Claims, 4 Drawing Figures

DISPLAY SHELF LOCK

SUMMARY OF THE INVENTION

This invention relates to shelf support brackets of the type having one or more hooks which engage slots in an upright support member. The invention is particularly directed to a lock which prevents unintended removal of the bracket hooks from the slots.

Shelves of the type described are utilized to display carpet samples wherein customers are invited to remove carpet samples from the shelf for insection. In the case of some bulkier carpet samples, a customer will sometimes fail to properly remove the sample from the shelf. Instead the customer grasps a portion of the shelf and tries to lift it with the result that the shelf bracket hooks tend to disengage from the slots of the upright support member. Also, sometimes when a customer tries to remove a sample from one shelf he accidently bumps a higher shelf, tending to dislodge it from the upright.

Accordingly, the primary objects of the present invention are to prevent inadvertent dislodgement of a sample shelf and to accomplish this by a shelf support lock which prevents inadvertent displacement of the bracket hooks associated with the shelf.

Another object is to construct a lock of the type described which is readily installed.

Another object is a lock of the type described which can be installed on either side of a shelf support bracket.

Another object is to construct a lock of the type described so it may be engaged in the same slot as a hook on the shelf support bracket.

Another object is a lock complying with the foregoing objects which can be fabricated in a single piece.

Another object is a lock of the type described which does not require any spring-loaded parts or the like.

Other objects will appear from time to time in the following specification, drawings and claims.

DETAILED DESCRIPTION OF THE INVENTION

Figure 1:
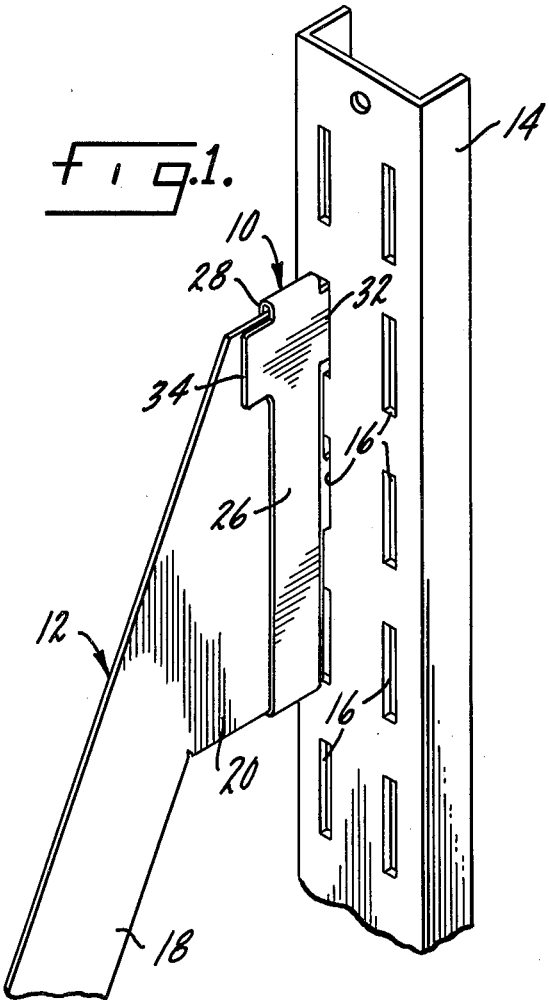
FIG. 1 is a perspective view of a shelf support lock according to the present invention, showing the lock in place on a shelf support bracket.
Figure 2:
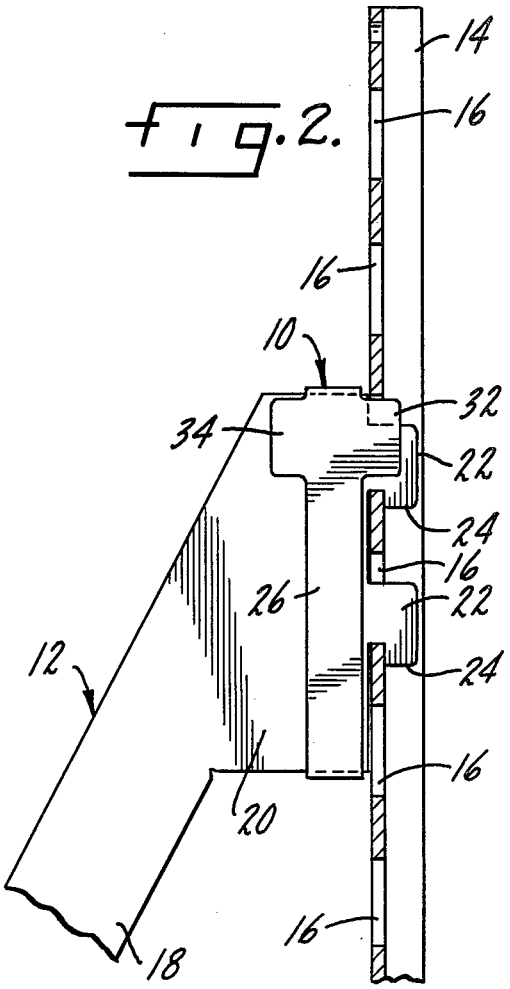
FIG. 2 is a side elevation view of a shelf support bracket and upright support member, with a shelf support lock according to the present invention in place.

A shelf support lock 10 constructed in accordance with the present invention, and its manner of use, are shown in FIGS. 1 and 2. The lock 10 fits on a shelf support bracket 12 to prevent it from disengaging the upright support member 14. The upright support member 14 has a plurality of slots 16. The upright member 14 is attached to a wall or otherwise held in vertical position. The slots 16 have a width suitable for receiving hooks of the shelf support bracket 12. The double row of vertically-spaced slots 16 is typical.

The shelf support bracket 12 has an arm 18 which terminates at a body portion 20. A pair of hooks 22 (FIG. 2) extend from the body portion to engage a slot 16 in the upright support member 14. Each hook has a downwardly extending finger portion 24 which engages the bottom edge of a slot 16 to prevent the shelf bracket from falling out of the slot. While the arm 18 of the bracket 12 has been shown as extending downwardly at an angle, it will be understood that other arrangements are possible and the present invention can be used with such alternate configurations, including the usual horizontal shelf support bracket.

Figure 3:
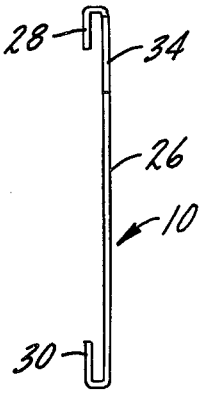
FIG. 3 is a side elevation view of the shelf support lock.
Figure 4:
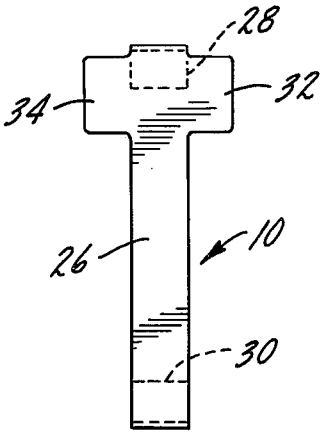
FIG. 4 is a front elevation view of the shelf support lock.

Looking at FIGS. 3 and 4, the parts of the lock 10, all of one-piece stamped metal are shown. The lock has a central member 26 which in the illustrated embodiment is an elongated member. At the upper end of the central member 26 is a first attachment clip 28. A second attachment clip 30 is formed at the bottom of the central member 26. Both the first and second attachment clips may advantageously be formed by bending the ends of the central member. An ear 32 is formed on the side of the central member 26. In a preferred embodiment a second ear 34 may be formed on the opposite side of the central member, giving the lock 10 a generally cruciform shape.

The use, operation and function of the invention are as follows:

The lock 10 is placed on the body portion 20 of the bracket 12 before the bracket is mounted on the upright support 14. The user slides the lock from the edge of the body portion having the hooks toward the arm 18 until the attachment clips 28 and 30 engage the body portion. When the ear 32 is clear of the hooks, the bracket 12 is inserted into the upright support with hooks 22 engaging slots 16. Then the user slides the lock toward the upright member 14 until the ear 32 projects into a slot 16. The ear 32 and the hook finger 24 prevent inadvertent removal of the shelf bracket.

With some bracket configurations it may be possible to use an alternate mounting procedure. In one such alternate procedure the shelf support bracket 12 is inserted into the upright support member 14 in the usual manner. Once this is done the bracket 12 will be in the position shown in FIGS. 1 and 2, with the fingers 24 of the hooks 22 engaging the bottom edge of slots 16. The lock 10 is then placed on the body portion 20 of the bracket 12 by first slipping the second attachment clip 30 on to the body portion 20 at a point near the junction of the body portion 20 and arm 18. Due to the angled shape of the arm the first attachment clip does not interfere with the top edge of the body portion while the second attachment clip is being engaged. The user then slides the lock toward the upright support member 14 so that the first attachment clip 28 engages the top of the body portion 20 of the bracket 12. At this point the first and second attachment clips will engage the body portion between the clip and the central member 26 of the lock. To fully engage the lock the user slides it toward the upright member 14 until the ear 32 of the lock projects into a slot 16 of the upright member 14. The location of the ear 32 along the central member 26 is such that the top edge of the ear is adjacent the top edge of the slot (see FIG. 2). In this position the ear prevents vertical motion of the bracket.

When the user wishes to remove the bracket, he simply removes the lock 10 by sliding it away from the upright member 14 and then lifting the bracket 12 up and out of the slots 16.

It will be understood that the above-described procedure may be somewhat different for other forms of shelf support brackets. But in any event the lock ends up with an ear projecting into a slot with the central member of the lock engaging the shelf support bracket.

One of the advantages of the present invention is that since it slidably engages the shelf support bracket and upright member there is no need for any springs or spring-loaded parts. No part of the lock undergoes tension, compression or bending in order to engage the lock. Since these types of actions tend to cause parts to fail, their absence in the present invention imparts inexpensive quality, greater durability and longer service life.

Another advantage of the present invention is the second ear gives the lock a symmetrical configuration which permits it to be attached to either side of a shelf support bracket. This is important because frequently the brackets will be installed in close quarters in which one side of the bracket may not be accessible. A good example is the double row of slots in the upright member 14 of FIG. 1. Once a first shelf support bracket is in place a second bracket placed adjacent to the first wall have only one side easily available for installing a lock. The lock of the present invention easily adapts to this situation.

A further advantage of the present lock is its simple design allows it to be formed from a one-piece stamping. Thus the lock can be economically manufactured with the same types of equipment used to manufacture the shelf support brackets themselves.

I claim:

1. In a shelf support bracket releasably attached to an upright support wherein the bracket has an arm terminating at a body portion with at least one hook extending therefrom to engage a slot in the upright support, the improvement comprising a lock for preventing inadvertent removal of the bracket hook from the support slot, the lock having first and second attachment clips which are slidably engageable with the body portion of the bracket such that the lock can be mounted on either side of the body portion and the lock having an ear which projects into a slot in the upright support, adjacent the top edge of the slot to prevent lifting of the bracket.

2. The structure of claim 1 wherein the lock has generally a cruciform shape including an elongated central member and a pair of ears, one extending in each direction from the central member.

3. The structure of claim 2 further comprising a first attachment clip at the top of the central member and a second attachment clip at the bottom of the central member.

4. The structure of claim 3 further characterized in that the lock is made from a one-piece stamping.

5. A lock for a shelf support bracket of the type having hooks engaging slots in an upright support, the lock comprising:

a central member;

first and second attachment clips connected to the central member, the first and second attachment clips coacting to hold the lock in slidable engagement on either side of the shelf support bracket; and an ear projecting from the central member and, when the lock is mounted on the shelf bracket, into a slot of the upright support, adjacent the top edge of the slot to prevent lifting of the shelf bracket.

6. The structure of claim 5 further comprising a second ear, projecting from the central member on the opposite side from the other ear.

7. The structure of claim 5 further characterized in that the lock is a unitary, one-piece structure.

* * * * *